US006037956A

United States Patent [19]

Allen

[11] Patent Number: 6,037,956

[45] Date of Patent: Mar. 14, 2000

[54] MICROFLUIDIC PRINTING APPARATUS HAVING TRANSPARENT INK RECEIVING ELEMENT

[75] Inventor: Loretta E. Allen, Hilton, N.Y.

[73] Assignee: Eastman Kodak Company, Rochester, N.Y.

[21] Appl. No.: 09/025,274

[22] Filed: Feb. 18, 1998

[51] Int. Cl.[7] ..... B41J 2/005

[52] U.S. Cl. ..... 346/140.1

[58] Field of Search ..... 346/140.1

[56] References Cited

U.S. PATENT DOCUMENTS 5,585,069 12/1996 Zanzucchi et al. .
5,593,838 1/1997 Zanzucchi et al. .
5,603,351 2/1997 Cherukuri et al. .
5,611,847 3/1997 Guistina et al. .

OTHER PUBLICATIONS

"Electroosmosis: A Reliable Fluid Propulation System for Flow Injection Analysis", by P. Dasgupta and S. Liu, Anal. Chem. 1994, vol. 66, No. 11, pp. 1792–1798.

*Primary Examiner*—N. Le
*Assistant Examiner*—Lamson D. Nguyen
*Attorney, Agent, or Firm*—Raymond L. Owens

[57] ABSTRACT

A microfluidic printing apparatus including at least one ink reservoir; a structure defining a plurality of chambers arranged so that the chambers form an array with each chamber being arranged to form an ink pixel; and a plurality of microchannels connecting the reservoir to a chamber. The printing apparatus further includes a plurality of microfluidic pumps each being associated with a single microchannel for supplying ink from an ink reservoir through a microchannel for delivery to a particular chamber for viewing; a moveable viewing and ink transfer assembly including a transparent lens and a transparent ink receiving element secured to the transparent lens, such assembly being effective in a first position for permitting a viewer to view an image and, in a second position, to cause ink to transfer from the chambers to the transparent ink receiving element; and the assembly is positioned after the ink has been transferred so as to be able to transfer ink from the transparent ink receiving element; and ink is transferred from the transparent ink receiving element to a receiver.

4 Claims, 10 Drawing Sheets

MICROFLUIDIC PRINTING APPARATUS HAVING TRANSPARENT INK RECEIVING ELEMENT

CROSS REFERENCE TO RELATED APPLICATIONS

Reference is made to commonly assigned U.S. patent application Ser. No. 08/918,368 (76396)filed Aug. 26, 1997 entitled "Microfluidic Printing on Diverse Receivers" to Fassler et al. The disclosure of this related application is incorporated herein by reference.

FIELD OF THE INVENTION

The present invention relates to printing high quality images by microfluidic transfer of inks onto receivers such as paper.

BACKGROUND OF THE INVENTION

Microfluidic pumping and dispensing of liquid chemical reagents is the subject of three U.S. Pat. Nos. 5,585,069, 5,593,838, and 5,603,351, all assigned to the David Sarnoff Research Center, Inc. The system uses an array of micron sized reservoirs, with connecting microchannels and reaction cells etched into a substrate. Electrokinetic pumps comprising electrically activated electrodes within the capillary microchannels provide the propulsive forces to move the liquid reagents within the system. The electrokinetic pump, which is also known as an electroosmotic pump, has been disclosed by Dasgupta et al., see "Electroosmosis: A Reliable Fluid Propulsion System for Flow Injection Analysis", Anal. Chem. 66, pp 1792–1798 (1994). The chemical reagent solutions are pumped from a reservoir, mixed in controlled amounts, and them pumped into a bottom array of reaction cells. The array may be decoupled from the assembly and removed for incubation or analysis. When used as a printing device, the chemical reagent solutions are replaced by dispersions of cyan, magenta, and yellow pigment, and the array of reaction cells may be considered a viewable display of picture elements, or pixels, comprising mixtures of pigments having the hue of the pixel in the original scene. When contacted with paper, the capillary force of the paper fibers pulls the dye from the cells and holds it in the paper, thus producing a paper print, or photograph, of the original scene. One problem with this kind of printer is the accurate control of the print density. The problem comes about because the capillary force of the paper fibers is strong enough to remove all the ink from the device, draining it empty. If the paper is not removed from contact with the ink cells at the correct time, the print density will be too high or too low. Moreover, the correct paper contact time varies with the ambient temperature, making the timing problem more difficult. Yet another problem is that different receivers will take up ink by capillary force at different rates, because of differences in paper fiber size and composition. Therefore, the timing problem will be complicated by requiring different removal times of the receiver when different receivers are used. One solution to this problem is given in the above mentioned copending application U.S. patent application Ser. No. 08/868,416 filed Jun. 3, 1997, where a special paper is employed which will absorb only a limited amount of ink. Nevertheless, it would be cheaper and simpler if plain paper can be employed for this kind of printing, and better still if a variety of papers can be employed as receivers. Another solution to this problem is given in the above mentioned copending application U.S. patent application Ser. No. 08/868,102, filed Jun. 3, 1997 wherein an array of microvalves, each individually addressed, controls the flow of ink to the paper. The complexity of individually addressed valves leads to a high cost printing apparatus.

Pad printing is the subject of many recent journal articles. "Everything you wanted to know about pad printing" recently published in Plastics News International states that "Padprinting is the latest technique for printing on objects that are not flat or that vary in size". Pad printing pads are made out of silicone rubber since it repels many substances, including ink, and because it can be molded into any given shape. In the pad printing process, the pad is brought into contact with a "cliche" that has been flooded with ink. The cliche is typically a thin metal plate into which an impression has been made. By flooding the cliche, ink is left in the impression. The printing process is completed when a silicone pad transfers the ink from the impression on the cliche to the article to be printed. Because the impression in the cliche is fixed, the next cycle of the padprinter will print the exact same image.

SUMMARY OF THE INVENTION

It is an object of this invention is to provide a microfluidic printer which can rapidly print high quality images on a variety of receivers. The receiver can be plain paper, coated paper, or heavy weight paper and the present invention provides for good control of the density and tone scale of the printed images.

These objects are achieved by a microfluidic printing apparatus comprising:

a) at least one ink reservoir;

b) a structure defining a plurality of chambers arranged so that the chambers form an array, with each chamber being arranged to form an ink pixel;

c) a plurality of microchannels connecting the reservoir to a chamber;

d) a plurality of microfluidic pumps each being associated with a single microchannel for supplying ink from an ink reservoir through a microchannel for delivery to a particular chamber for viewing;

e) moveable viewing and ink transfer means including a transparent lens and transparent ink receiving element secured to the transparent lens, such means being effective in a first position for permitting a viewer to view an image and, in a second position, to cause ink to transfer from the chambers to the transparent ink receiving element;

f) means for positioning the moveable ink transfer means after the ink has been transferred so as to be able to transfer ink from the transparent ink receiving element; and g) means for transferring the ink from the transparent ink receiving element to a receiver.

ADVANTAGES

A feature of the present invention is that the image may be viewed before and during printing.

Another feature of the invention is that printer apparatus which use the present invention can have a minimum depth from the viewing point to the actual image plane.

Another feature of the invention is that it produces high quality prints of the correct density on a variety of receivers.

Another feature of the invention is that the printer apparatus in accordance with the present invention use low power and can be compact and portable.

Another feature of the invention is that there is no image reversal between the viewed and printed image.

Another feature of the invention is that a different image can be printed during each printing cycle.

BRIEF DESCRIPTION OF THE DRAWINGS

FIGS. 11 and 12 show various positions of the transparent ink receiving element where it has been moved to during rocking action of the actuator to transfer ink to a receiver.

DETAILED DESCRIPTION OF THE INVENTION

The present invention is described in relation to a microfluidic printing apparatus which can print computer generated images, graphic images, line art, text images and the like, as well as continuous tone images.

Figure 1:
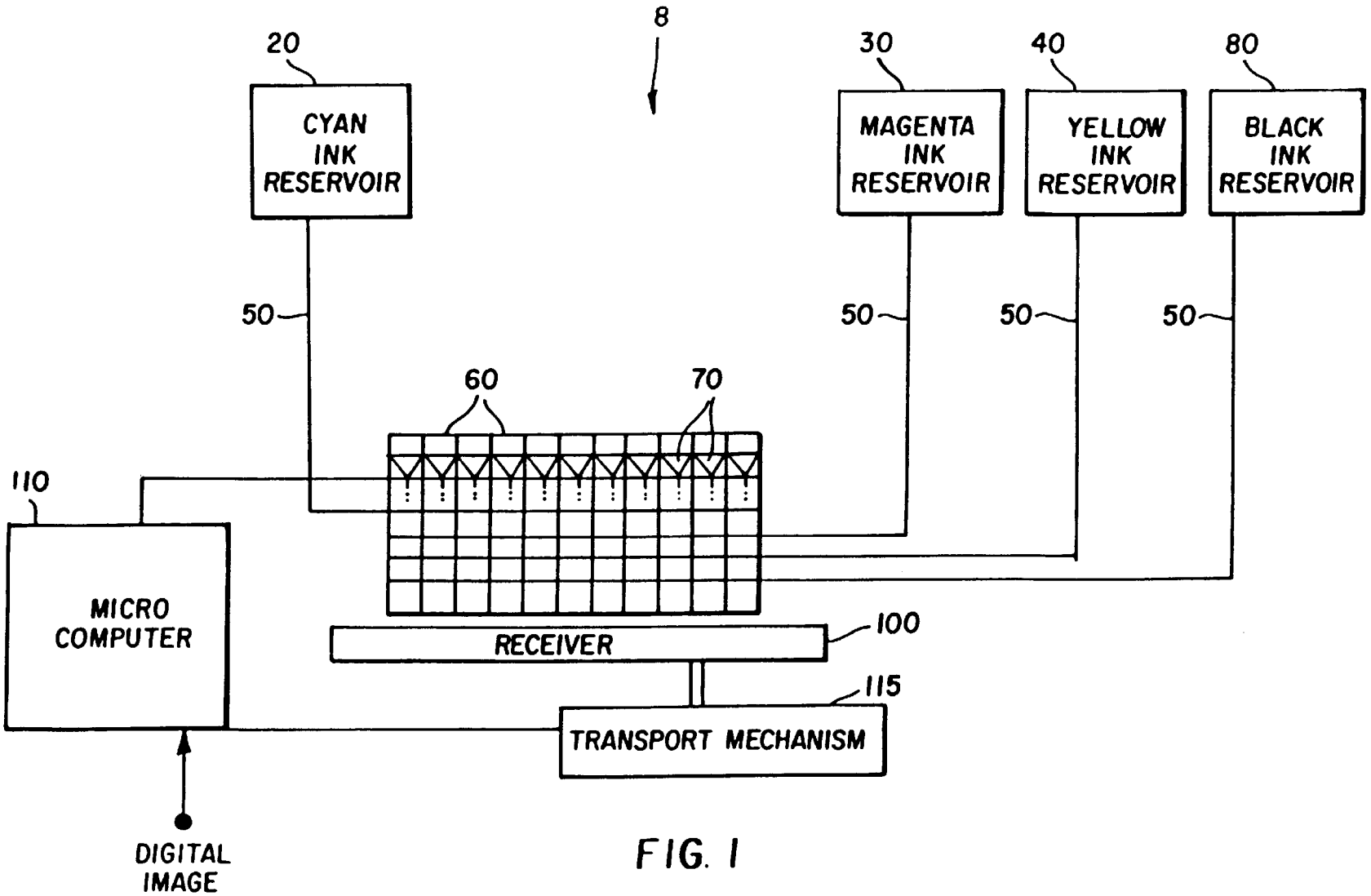
FIG. 1 is a partial schematic showing a microfluidic printing apparatus for printing a digital image on a reflective receiver.

Referring to FIG. 1, a schematic diagram is shown of a printing apparatus 8 in accordance with the present invention. Reservoirs 20, 30, and 40 are respectively provided for holding cyan ink, magenta ink, and yellow ink. An optional reservoir 80 is shown for black ink. Microchannel capillaries 50 respectively connected to each of the reservoirs conduct ink from the corresponding reservoir to ink chambers 60 arranged to form an array. In the present invention, the ink chambers 60 deliver the inks directly to a receiver; however, other types of ink delivery arrangements can be used such as microfluidic channels, and so when the word chamber is used, it will be understood to include those arrangements. The colored inks are delivered to ink chambers 60 by electrokinetic pumps 70. The amount of each color ink is controlled by microcomputer 110 according to the input digital image. For clarity of illustration, only one set of electrokinetic pumps is shown for the yellow ink channel. Similar pumps are used for the other color channels, but these are omitted from the figure for clarity. Finally, a receiver 100 is transported by a transport mechanism 115 to come in contact with the microfluidic printing apparatus 8. The receiver 100 receives the ink and thereby produces the print. Receivers may include common bond paper, made from wood fibers, as well as synthetic papers made from polymeric fibers. It will be understood that the receiver 100 can be plain paper, coated paper, or heavy weight paper, and the present invention provides for good control of the density and tone scale of the printed images. In addition the receiver can be of non-fibrous construction, provided the receiver 100 can absorb and hold the ink used in the printing apparatus 8.

Figure 2:
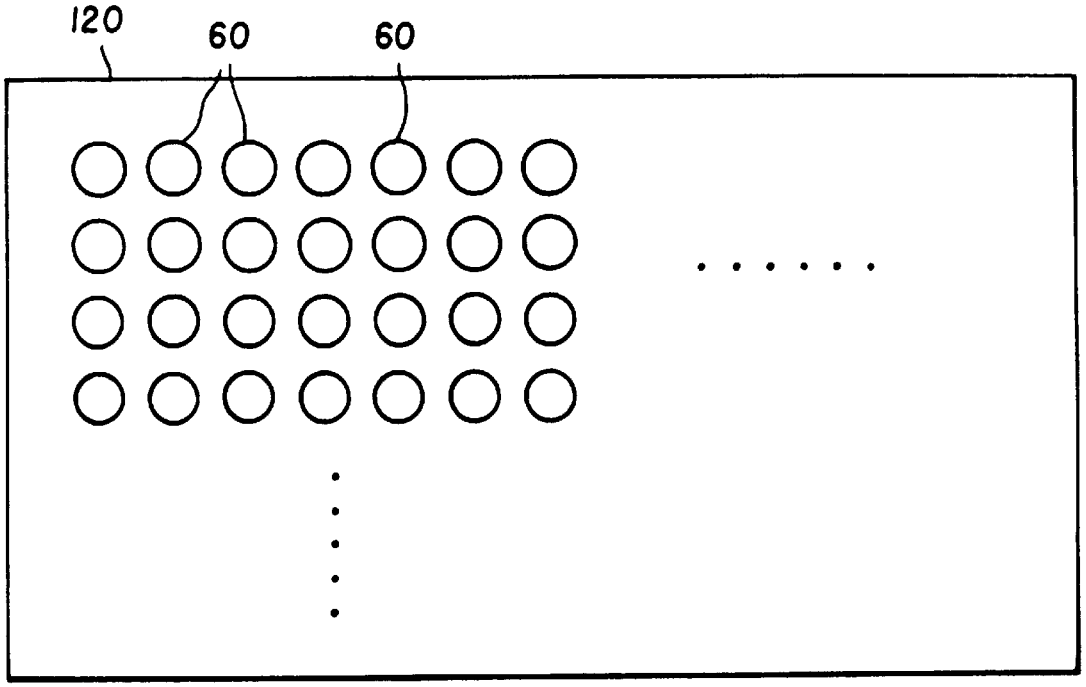
FIG. 2 is a top view of a pattern of the color pixels which can be produced by apparatus in accordance with the present invention.

FIG. 2 depicts a top view of an arrangement of chambers 60 in a printing plate 120 shown in FIG. 1. Each ink chamber 60 is capable of producing a mixed ink having any color saturation and hue within the color gamut provided by the set of cyan, magenta and yellow inks used in the apparatus.

The inks used in this invention are dispersions of colorants in common solvents.

The microchannel capillaries 50, ink pixel chambers 60 and electrokinetic pumps are more fully described in the references listed above.

Figure 3:
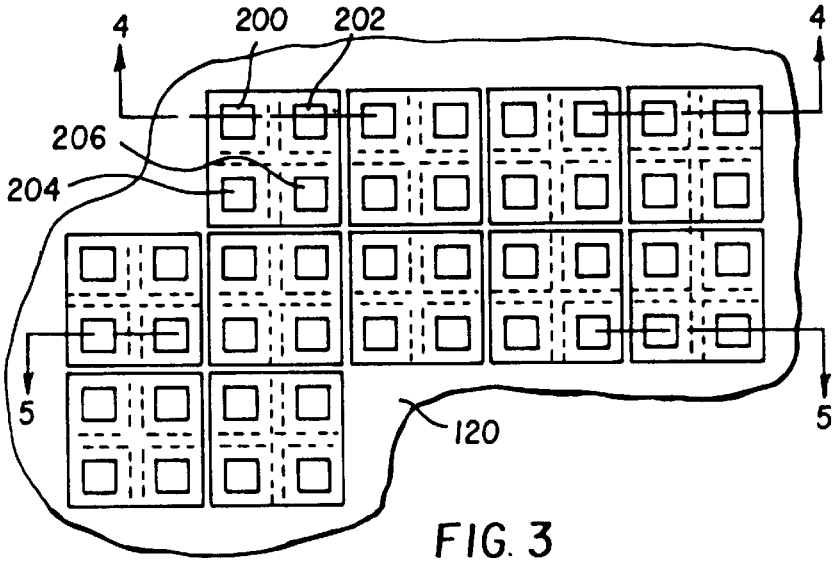
FIG. 3 is a top view of a second pattern of the color pixels which can be produced by apparatus in accordance with the present invention.
Figure 4:
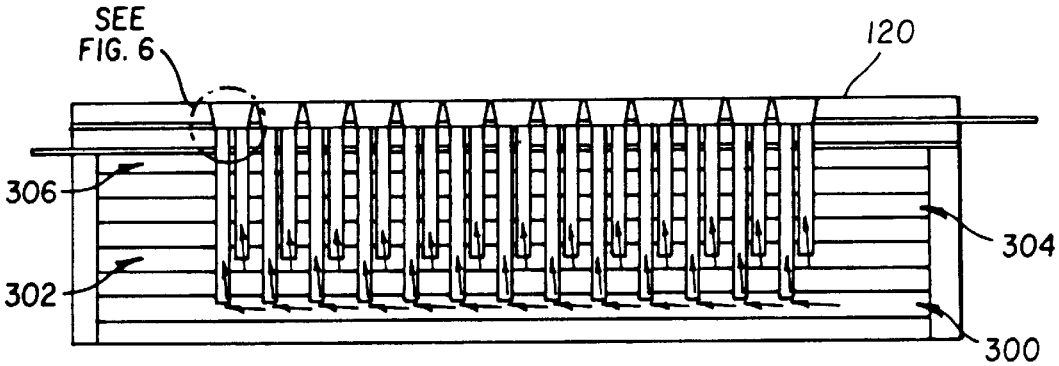
FIG. 4 is a cross-sectional view taken along the lines 4—4 of the microfluidic printing apparatus in FIG. 3.
Figure 5:
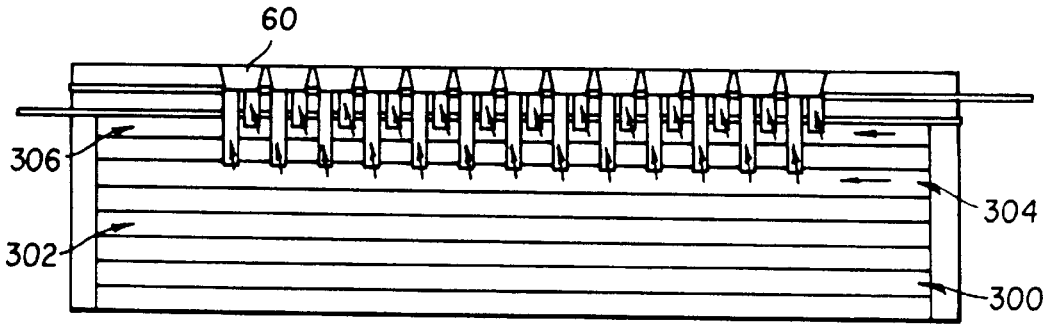
FIG. 5 is another cross-sectional taken along the lines 5—5 of the microfluidic printing apparatus in FIG. 3.

Cross-sections of the color pixel arrangement shown in FIG. 3 are illustrated in FIG. 4 and FIG. 5. Colored ink supply lines 300, 302, 304, and 306 are fabricated in channels parallel to the printing plate 120. The cyan, magenta, yellow and black inks are respectively delivered by colored ink supply lines 300, 302, 304, and 306 into each of the colored ink chambers 60.

Figure 6:
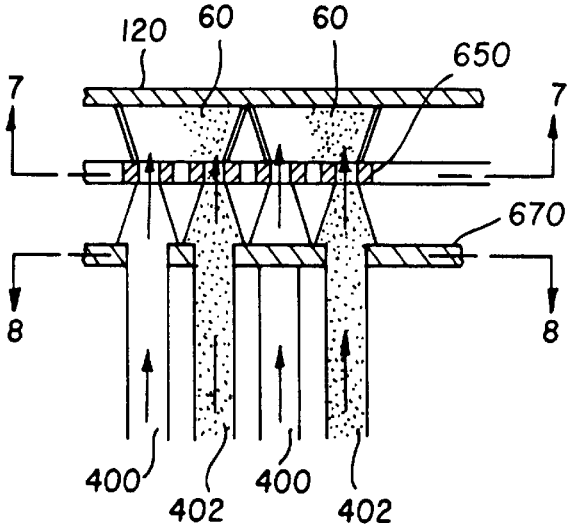
FIG. 6 is an enlarged view of the circled portion of FIG. 4.
Figure 8:
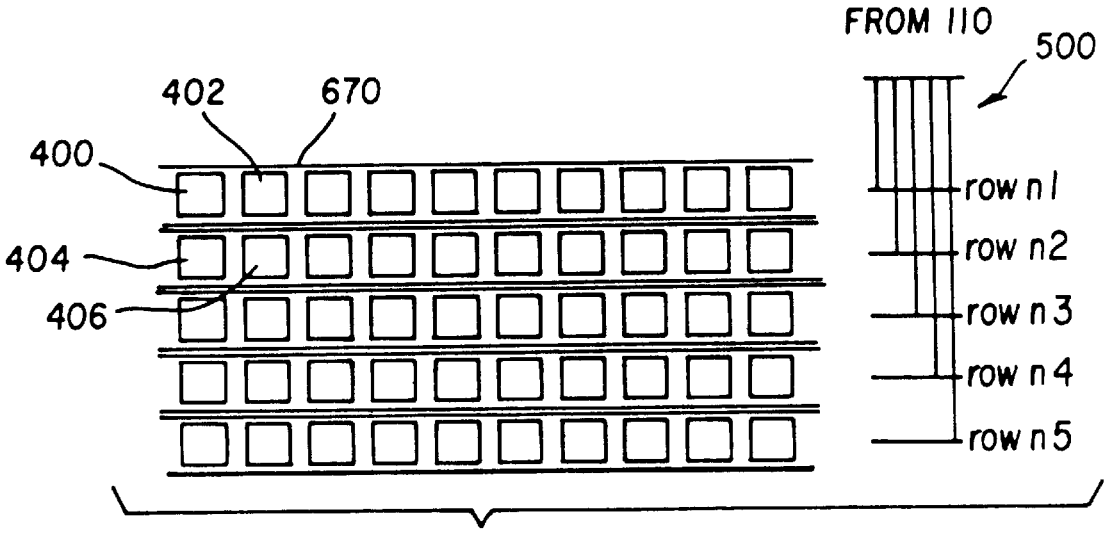
FIG. 8 is a top view of the microchannel and showing conducting circuit connections in FIG. 6.

A detailed view of the cross-section in FIG. 4 is illustrated in FIG. 6. The colored inks are delivered to the ink chambers 60 respectively by cyan, magenta, yellow, and black ink microchannels 400, 402, 404, and 406 (404 and 406 do not show up in the plan shown in FIG. 6, but are illustrated in FIG. 8). The colored ink microchannels 400, 402, 404, and 406 are respectively connected to the colored ink supply lines 300, 302, 304, and 306 (FIGS. 4 and 5).

Figure 7:
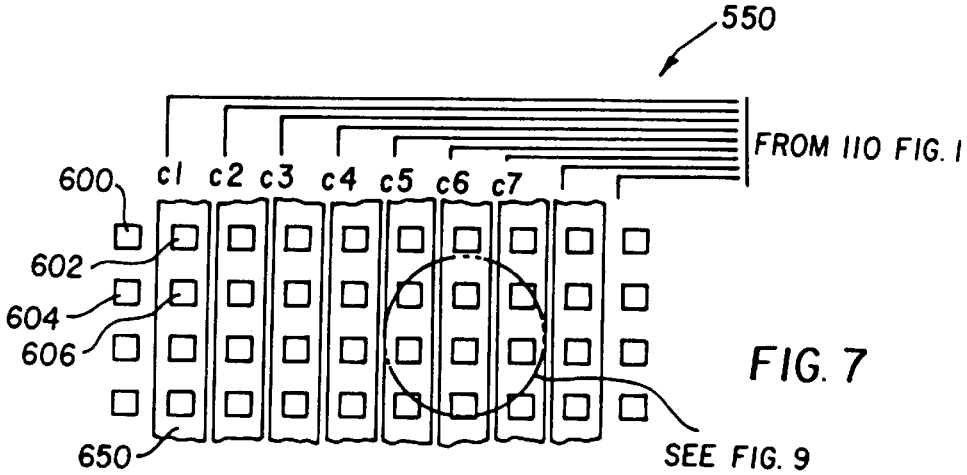
FIG. 7 is a top view of the micronozzles shown in FIG. 6.

A cross-section view of the plane containing the micronozzles in FIG. 6 is shown in FIG. 7. The cyan, magenta, yellow, and black ink micro-orifices or micronozzles 600, 602, 604, and 606 are distributed in the same arrangement as the colored ink supply lines 300–306 and the termination of the chambers 60 which are colored ink orifices 200–206. Column electrodes 650 are shown connected to the conducting leads 550, which is further connected to microcomputer 110.

A cross-section view of the plane containing the microchannels 400, 402, 404, and 406 in FIG. 6 is shown in FIG. 8. The color ink microchannels 400–406 are laid out in the spatial arrangement that corresponds to those in FIGS. 3 and 7. The lower electrodes in the electroldnetic pumps for delivering the colored inks are not shown for clarity of illustration. Row electrodes 670 are connected to lower electrodes of the electrokinetic pumps. The row electrodes 670 are shown connected to a conducting leads 500, which is further connected to microcomputer 110.

Figure 9:
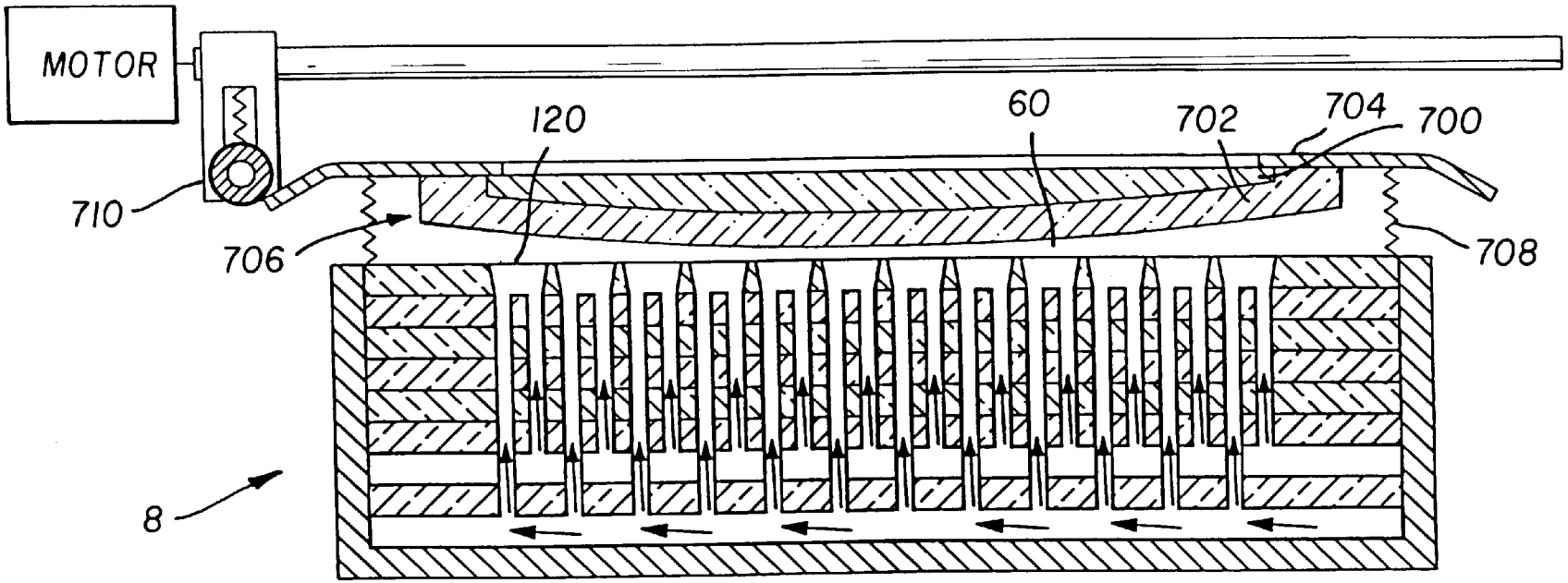
FIG. 9 is a cross-sectional view taken along the lines 4—4 of the microfluidic printing apparatus in FIG. 3 showing a transparent ink receiving element and its actuator in accordance with the present invention.

FIG. 9 is a side view of the printing apparatus 8 configured with a moveable transparent lens 700 attached to a transparent ink receiving element 702. In this case, the transparent lens 700 has a cylindrical surface on one side (bottom), and a flat surface on the other side (top). The transparent ink receiving element 702 is attached to the cylindrical surface of the transparent lens 700. The flat surface of the transparent lens 700 is attached to a backing plate 704. The backing plate 704 has a substantial open area in the center and enough overlap for attaching the transparent lens 700 to it. Preferably, the transparent lens 700 is a glass optical lens, and the backing plate 704 is formed of a metal such as aluminum. The transparent lens 700 can be fastened to the backing plate 704 using a suitable adhesive. The transparent ink receiving element 702 is a coating, preferably silicone rubber having a surface compliance softer than the receiver 100, and is formed to the same contour as the cylindrical surface of the transparent lens 700. Since the adhesion between silicone and glass is minimal, the silicone overlaps onto the aluminum plate where it will have better adhesion. The transparent ink receiving element 702 has a function similar to that of the pad in the padprinting process. A printer assembly 706, which includes the ink receiving element 702, is moveable to a first position which permits a viewer to view an image. As should be clear from FIG. 9, the printer assembly 706 also includes the transparent lens 700, transparent ink receiving element 702 and backing plate 704. If the image is acceptable, it is moved to a second or ink transfer position so that ink can be transferred from the transparent ink receiving element 702 to the receiver 100 as will be discussed later. Suffice it here to say, in the second position, a rocking motion is applied by the printer assembly 706 to cause the transparent ink receiving element 702 to transfer ink to the receiver 100.

During the printing cycle of this invention, the printer assembly 706 is positioned above and out of contact with the printing plate 120 by springs 708. Ink is then delivered to the ink chambers 60 by the ink delivery process described earlier. At this time, the image to be printed can be viewed by looking through transparent lens 700, and is right readable to the viewer.

Figure 10:
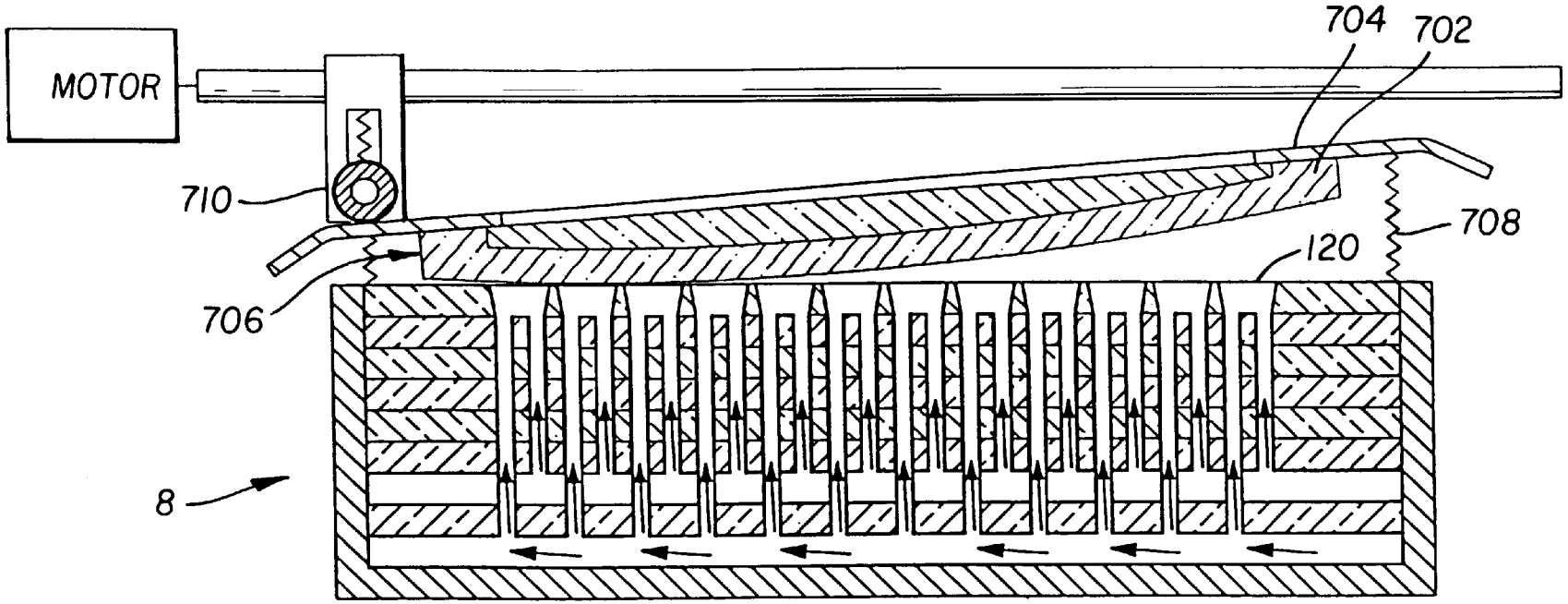
FIGS. 10, 11, and 12 are similar views but FIG. 10 shows the transfer of ink to the transparent ink receiving element

FIG. 10 shows the same view as FIG. 9, but where the printer assembly 706 has been moved into contact with the printing plate 120 by an actuator 710. The actuator shown is this invention is a spring biased roller (but can be other types such as an electromagnetic actuator) and causes the printer assembly 706 to move with rocking motion on its cylindrical surface by rolling across the backing plate 704 of printer assembly 706. The printer assembly 706 is designed to rock across the printing plate 120 rather than contact it flatly so as not to trap air between the printing plate 120 and the transparent ink receiving element 702. As shown here, the printer assembly has started its traverse across the printing plate 120.

Figure 11:
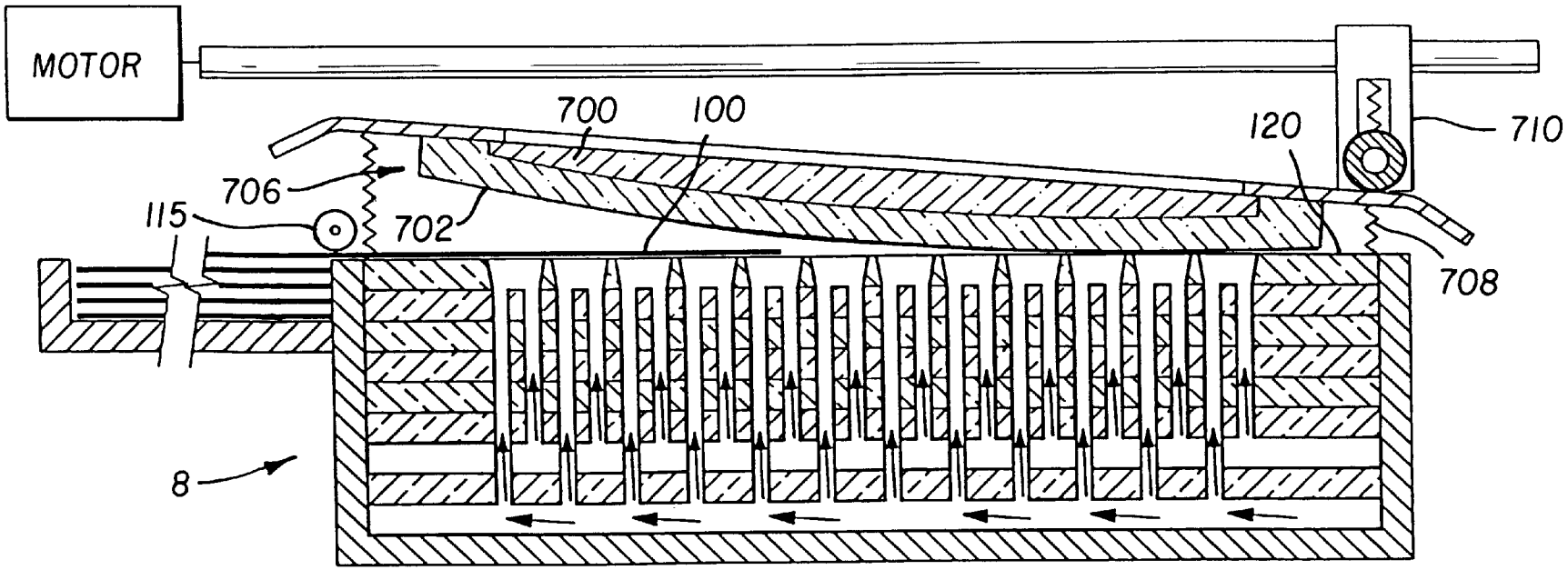

FIG. 11 shows the same view as FIG. 10, but where the actuator 710 has traversed completely to the right causing the printer assembly 706 to completed its traverse across the printing plate 120. The ink image is now on the transparent ink receiving element 702 of printer assembly 706, and if viewed through transparent lens 700, will again be right reading to the viewer. This view also shows a receiver 100 being positioned in registration with the printer assembly 706 by transport mechanism 115. The transport mechanism 115 can begin to move the receiver 100 as soon as enough clearance is created between the printing plate 120 and the transparent ink receiving element 702 as the printer assembly 706 is rocked to the right.

Figure 12:
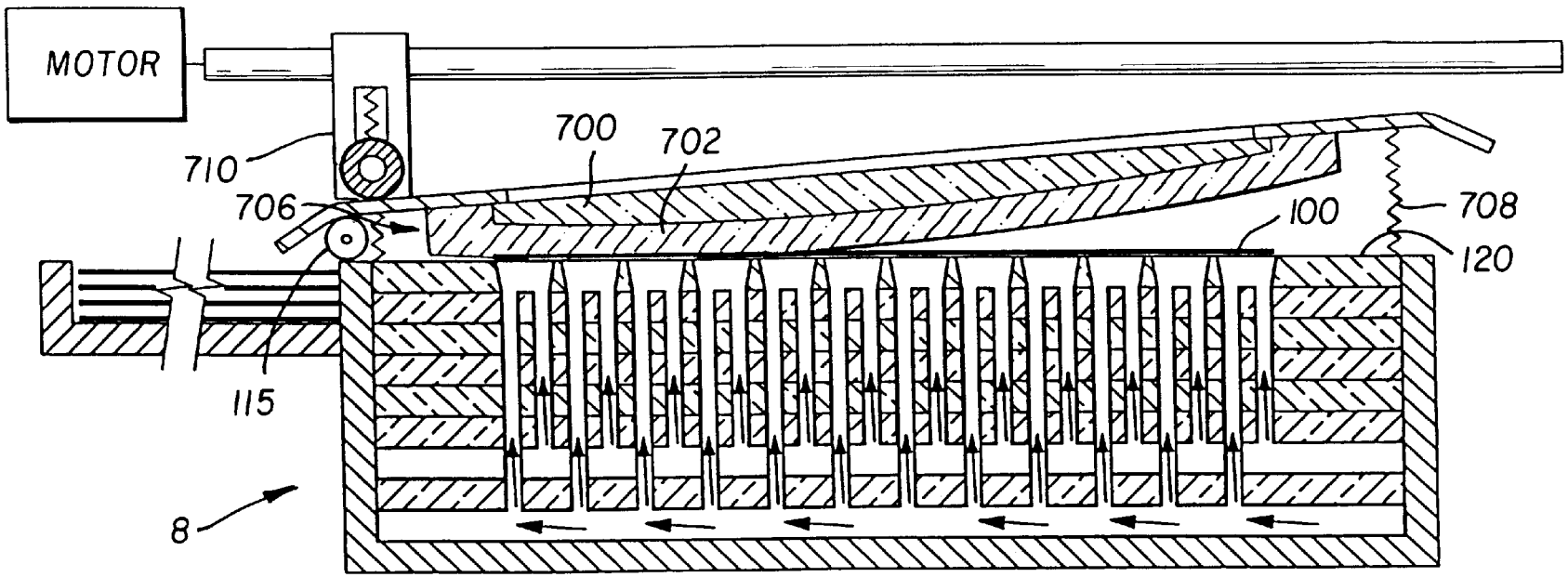

FIG. 12 shows the same view as FIG. 11, but with the receiver 100 in registration with the printer assembly 706, and the printer assembly 706 completing its traverse to the left. As the printer assembly 706 is rocked to the left by actuator 710, the ink image on the transparent ink receiving element 702 is transferred to the receiver 100. The printing cycle is now complete, and the printer assembly 706 is returned to its original position as shown in FIG. 9. The receiver 100 can now be removed from the apparatus.

Figure 13:
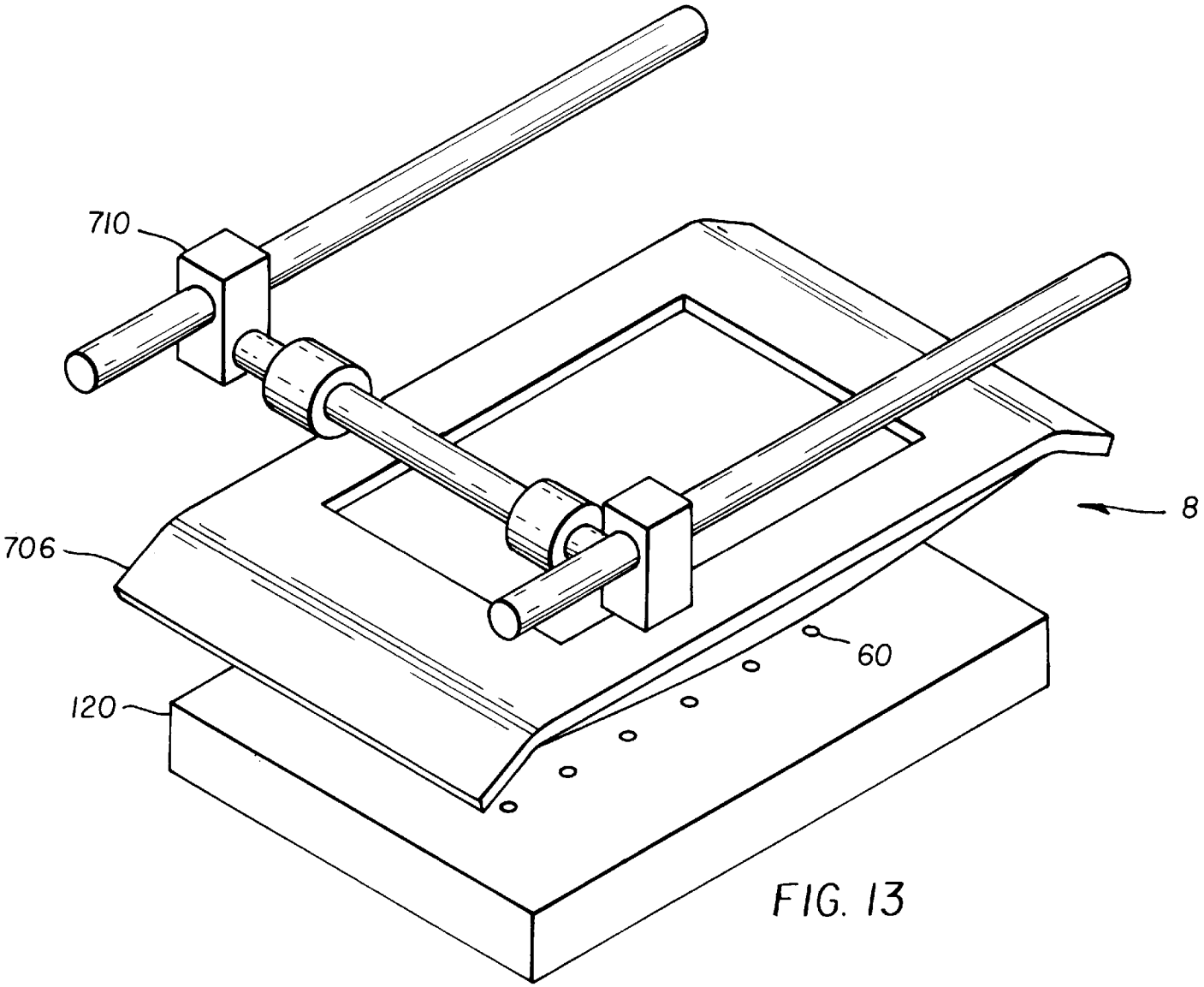
FIG. 13 is an exploded isometric view of the printing apparatus shown in FIGS. 9–12.

FIG. 13 shows an exploded view of the printing apparatus 8. In this view you can see the opening in the backing plate 704 through which the user can view the image being formed on the printing plate 120, or being printed on a receiver 100.

The operation of a microfluidic printing apparatus 8 comprises the steps of activating the electrokinetic pumps to pump the correct amount of each color ink to the chamber 60 to provide a pixel of the correct hue and intensity corresponding to the pixel of the scene being printed. The printing plate 120 can be fabricated from, or be coated with a white reflecting material so that the ink chambers 60 which correspond to the pixels of the image render an accurate impression of the image when viewed by the operator. After the ink is pumped to the chambers 60, the surface of the ink dries and becomes tacky. The printer assembly 706 is rocked across and in contact with the printing plate 120 to pick up or transfer the ink image from the ink chambers 60. The ink is now on the transparent ink receiving element 702 of printer assembly 706. The ink dries and becomes more tacky while it is on the transparent ink receiving element 702. The printer assembly 706 is rocked across and in contact with the receiver 100 to effect transfer of the inked image onto the receiver 100. At all times, the image is right viewable, and can be viewed through the transparent lens 700 of printer assembly 706. The compliance of the transparent ink receiving element 702 and the tackiness of the ink ensure that the ink will be transferred to the receiver 100, even if a variety of different receiver are used.

The invention has been described in detail with particular reference to certain preferred embodiments thereof, but it will be understood that variations and modifications can be effected within the spirit and scope of the invention.

Parts List

8—microfluidic printing apparatus
20—cyan ink reservoir
30—magenta ink reservoir
40—yellow ink reservoir
50—microchannel capillaries
60—ink chambers, or printing nozzles
70—electrokinetic pumps
80—black ink reservoir
100—receiver
110—microcomputer
115—transport mechanism
120—printing plate
200—colored ink orifices
202—colored ink orifices
204—colored ink orifices
206—colored ink orifices
300—colored ink supply lines
302—colored ink supply lines
304—colored ink supply lines
306—black ink supply
400—cyan ink microchannel
402—magenta ink microchannel
404—yellow ink microchannel
406—black ink microchannel
500—conducting leads
550—conducting leads
600—cyan ink micro-orifice
602—magenta ink micro-orifice
604—yellow ink micro-orifice
606—black ink micro-orifice
650—column electrodes
670—row electrodes
700—transparent lens
702—transparent ink receiving element

704—backing plate
706—printer assembly
708—springs
710—actuator

What is claimed is:

1. A microfluidic printing apparatus for printing ink images comprising:

a) a plurality of ink reservoirs each containing ink;

b) a structure defining a plurality of chambers arranged so that the chambers form an array, with each chamber being arranged to form an ink pixel;

c) a plurality of microchannels, each microchannel being connected to one of the reservoirs and to one of the chambers;

d) a plurality of microfluidic pumps each being associated with a single microchannel for supplying ink from its connected ink reservoir through its connected microchannel for delivery to a particular chamber for viewing;

e) moveable viewing and ink transfer means including a transparent lens and transparent ink receiving element secured to the transparent lens, such means being effective in a first position for permitting a viewer to view an image and, in a second position, to cause ink to transfer from the chambers to the transparent ink receiving element;

f) means for positioning the moveable ink and transfer means after the ink has been transferred so as to be able to transfer ink from the transparent ink receiving element; and g) means for transferring the ink from the transparent ink receiving element to a receiver.

2. The microfluidic printing apparatus of claim 1 wherein the transparent lens includes a cylindrical surface.

3. The microfluidic printing apparatus of claim 1 wherein the transparent ink receiving element is formed from silicone rubber.

4. The microfluidic printing apparatus of claim 1 further including means for providing a rocking motion to the transparent lens to transfer ink from the chambers to the transparent ink receiving element and for providing a rocking motion to the transparent lens to transfer ink from the transparent ink receiving element to a receiver.

* * * * *